US005941107A

United States Patent [19]

Hsu

[11] Patent Number: 5,941,107

[45] Date of Patent: Aug. 24, 1999

[54] ELECTRONIC LOCK WITH MANUAL OVERRIDE

[76] Inventor: Chen Yun Hsu, 14-44 150th St., Whitestone, N.Y. 11357

[21] Appl. No.: 09/111,227

[22] Filed: Jul. 7, 1998

[51] Int. Cl.[6] ..... E05B 47/06

[52] U.S. Cl. ..... 70/278.3; 70/279.1; 70/283; 70/283.1; 70/339; 70/DIG. 60

[58] Field of Search ..... 70/337, 339, DIG. 63, 70/DIG. 60, 277, 278.1–278.7, 279.1, 280–283, 283.1

[56] References Cited

U.S. PATENT DOCUMENTS

| | | | |
|---|---|---|---|
| 1,833,572 | 11/1931 | Hardesty | 70/283 |
| 3,751,088 | 8/1973 | Schlage et al. | 70/281 X |
| 4,068,507 | 1/1978 | Peterson | 70/337 X |
| 4,225,008 | 9/1980 | Colell et al. | 70/337 X |
| 5,388,435 | 2/1995 | Bailey | 70/339 X |

*Primary Examiner*—Lloyd A. Gall

*Attorney, Agent, or Firm*—Friscia & Nussbaum

[57] ABSTRACT

The present invention relates to an electronic lock having first and second disposed in axial alignment is provided. A first key inserted into the cylinders of the electronic lock sends an electronic signal to a solenoid which retracts a stopper from engagement with a latch plate upon turning the first key through an initial angle. Thereafter, the first key drives the first cylinder to drive a first cam which moves against a first cam follower to move the latch plate and withdraw the latch from locking engagement. In the event of an electronics failure and/or in order to manually override the electronics, a second key is inserted into the axially aligned cylinders. The second key initially drives the second cylinder to move a second cam against a second cam follower that bears against the stopper to remove the stopper from engagement with the latch plate. Thereafter, continued movement of the second key allows for engagement of the second key with the first cylinder to move the first cylinder and the first cam attached thereto to contact the first cam follower associated with the latch plate to withdraw the latch plate into the lock housing to unlock the lock.

15 Claims, 5 Drawing Sheets

ELECTRONIC LOCK WITH MANUAL OVERRIDE

BACKGROUND OF THE INVENTION

1. Field of the Invention

This invention generally relates to an electronic lock having a manual override which can be manually actuated in the event of a failure of the associated electronics. More particularly, the present invention relates to an electronic lock having an electronically controlled stopper which is actuated by a first electronic key to electronically remove the stopper from engagement with a latch assembly. Continued movement of the first key moves the latch to open the lock. The lock can also be actuated by a second manual key assembly which includes a cam that drives a cam follower interconnected with the stopper to manually remove the stopper from engagement with the latch assembly. Continued movement of the second key moves the latch assembly to open the lock to allow for manual actuation of the latch assembly to manually open the electronic lock.

2. Related Art

Security locks are necessary and widely used for public telephones, vending machines and other devices which are the subject of thefts and/or targets for vandals. Because the coin banks within such devices hold relatively large amounts of money, the devices become attractive targets. Additionally, these devices are often times located in remote areas which increases the likelihood that the devices will become targets. Further, often times there is valuable electronic equipment contained within such devices which even further increases the likelihood that such devices will become targets for theft.

Additionally, it is common that the keys to such devices are provided to service men or money collectors to allow them access to the interior of the housing to either service the machine or collect money that has been deposited in the machine. In order to provide security, it is desirable to utilize an electronic lock, i.e., a lock having a stopper that coacts with a latch assembly that prevents movement of the latch and operation of the lock unless and until the stopper is withdrawn from engagement with the latch assembly. The stopper is typically moved by a solenoid switch which is electronically actuated. A major advantage of using an electronic lock, apart from security, is that access to the housing can be monitored and then checked. In this way, one can be prevented from visiting a device more than once in a day. The data that the electronic lock assembly acquires can be used to track the usage thereof.

However, one problem that exists with electronic locks is that if for some reason the electronics fail, there is no suitable way of actuating the lock to access the housing. Accordingly, in cases where the electronics fail, often times the lock must be destroyed in order to gain access to the housing. This results in expensive property damage and the lock must be replaced. Even the housing can be damaged in such instances.

Accordingly, what is desired and has not heretofore been developed is an electronic lock which is electronically actuated by a first key, but which can also be manually actuated by a second key to withdraw a stopper from engagement with a latch to allow the lock to be actuated in the event of an electronics failure, and/or to allow one to manually override the electronic controls associated with an electronic lock.

OBJECTS AND SUMMARY OF THE INVENTION

It is a primary object of the present invention to provide an electronic lock which can be manually actuated.

It is also an object of the present invention to provide an electronic lock which can be manually actuated in the event of an electronics failure.

It is another object of the present invention to provide an electronic lock which can be manually overridden.

It is an additional object of the present invention to provide an electronic lock having a stopper which is electronically retracted from engagement with a latch plate assembly to allow for movement of a latch plate, which stopper can be manually removed from engagement with the latch plate.

It is still another object of the present invention to provide an electronic lock wherein a cam follower interferes with the stopper, and the lock includes a cam which can be actuated to coact with the cam follower to move the stopper from engagement with the latch plate.

It is still another object of the present invention to provide an electronic lock that can be manually actuated, which lock includes a first cylinder and a second cylinder disposed in axial alignment.

It is still even an additional object of the present invention to provide an electronic lock which can be actuated by a first key that coacts with the first cylinder to electronically move a stopper from engagement with a latch plate, and then moves the latch plate itself to open the lock.

It is still even an additional object of the present invention to provide an electronic lock which further includes a second key that first coacts with the second cylinder to move a cam which contacts a cam follower to remove a stopper from engagement with a latch plate, the second key further including means for subsequently coacting with the first cylinder to move the latch plate assembly from a locked position to an unlocked position.

An electronic lock having first and second cylinders disposed in axial alignment is provided. A first key inserted into the cylinders of the electronic lock sends an electronic signal to a solenoid which retracts a stopper from engagement with a latch plate upon turning the first key through an initial angle. Thereafter, the first key drives the first cylinder to drive a first cam which moves against a first cam follower to move the latch plate and withdraw the latch from locking engagement. In the event of an electronics failure and/or in order to manually override the electronics, a second key is inserted into the axially aligned cylinders. The second key initially drives the second cylinder to move a second cam against a second cam follower that bears against the stopper to remove the stopper from engagement with the latch plate. Thereafter, continued movement of the second key allows for engagement of the second key with the first cylinder to move the first cylinder and the first cam attached thereto to contact the first cam follower associated with the latch plate to withdraw the latch plate into the lock housing to unlock the lock.

BRIEF DESCRIPTION OF THE DRAWINGS

Other important objects and features of the invention will be apparent from the following Detailed Description of the Invention taken in connection with the accompanying drawings in which.

DETAILED DESCRIPTION OF THE INVENTION

The present invention is related to an electronic lock which can be manually actuated in the event of a failure of the electronic components and/or in the event that it is desired to manually actuate the electronic lock.

Figure 1:
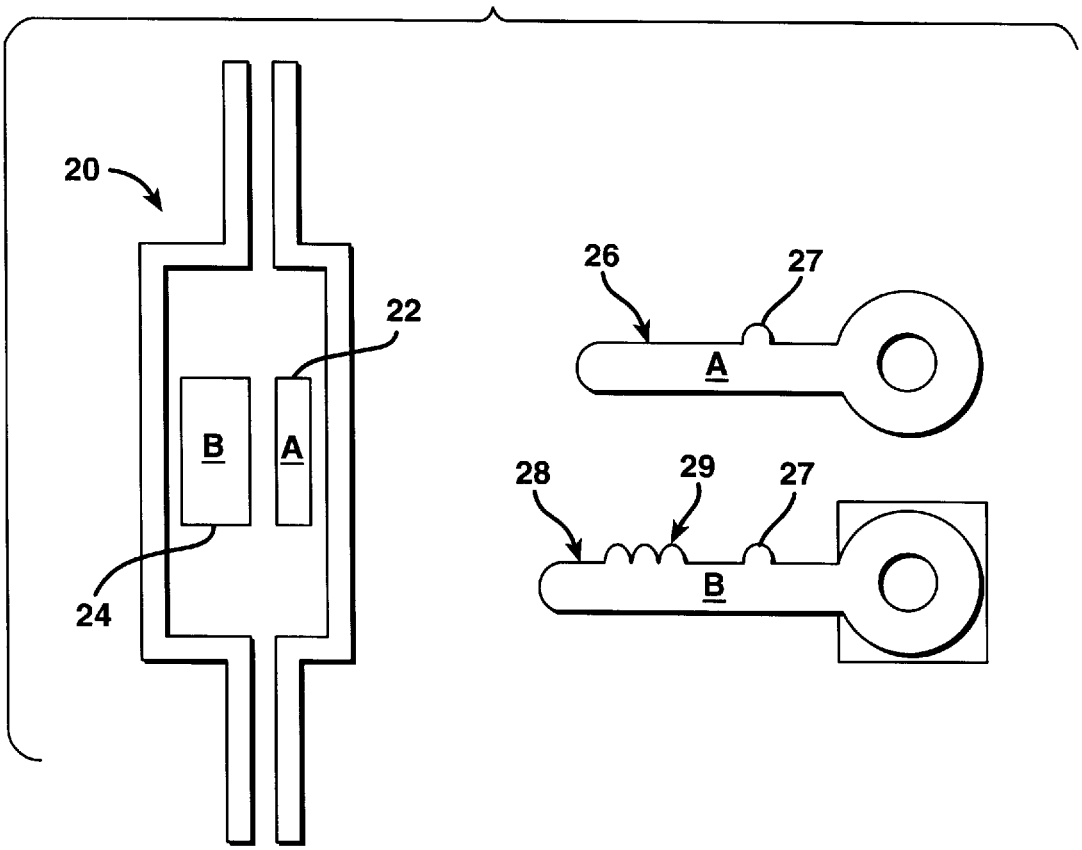
FIG. 1 is a side view of the lock housing of the present invention showing first and second housings A and B and corresponding first and second keys A and B.

Referring to FIG. 1, a side view of the lock housing 20 is shown with first cylinder 22 and second cylinder 24 positioned in axial alignment within the housing. Also shown is first key 26 and second key 28. First key 26 is an electronic key which coacts with first cylinder 22 to electronically actuate the lock. Second key 28 can be used to manually actuate the lock in case of an electronics failure or otherwise to open the lock as will be hereinafter described. First key 26 includes first cylinder actuation means 27, while second key 28 includes first cylinder actuation means 27 and second cylinder actuation means 29, the purposes of which will be hereinafter discussed.

Figure 2:
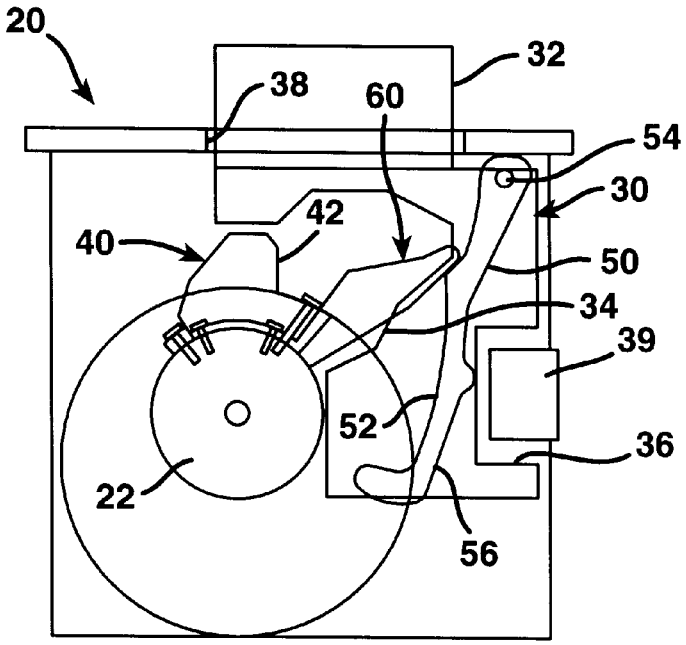
FIG. 2 is a top schematic view of the lock shown in FIG. 1.
Figure 3:
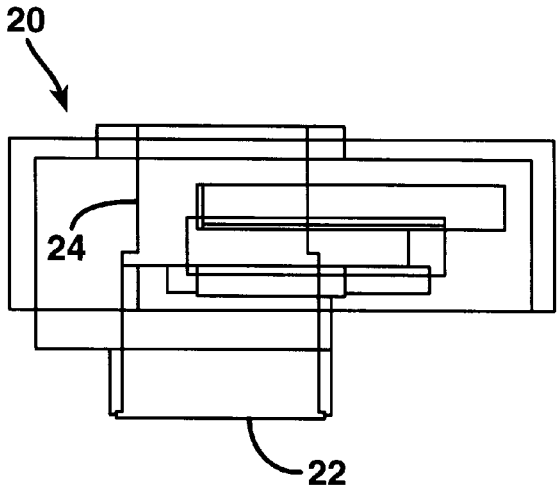
FIG. 3 is an upper edge schematic view of the lock shown in FIG. 2.

Referring to FIG. 2, the lock assembly is shown from a top view. As can be seen, the lock housing, generally indicated at 20, includes a first cylinder 22 and a second cylinder 24 positioned in axial alignment. Second cylinder 24 can be shown in FIG. 3 which is an upper edge schematic view of the lock housing 20.

Figure 4:
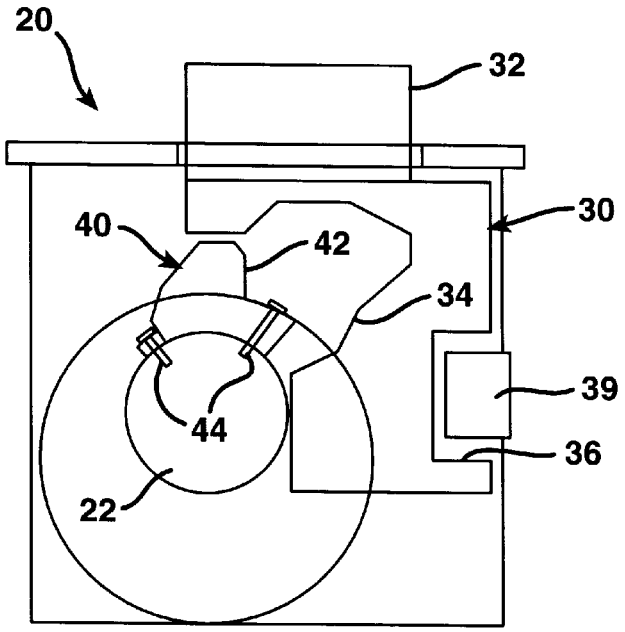
FIG. 4 is a top plan view of the first portion of the lock shown in FIGS. 1 and 2 and the latch plate.

Referring back to FIG. 2, and as also shown in FIG. 4, the lock housing 20 carries a latch plate 30 therein. Latch plate 30 includes a latch 32 which extends through a latch aperture 38 in the housing 20. Latch 32 extends into and engages a receptacle positioned in alignment therewith (not shown) to secure the portion of the device housing (not shown) on which the lock housing 20 is mounted with respect to the device housing. Once the latch 32 is withdrawn into the lock housing 20, the process of which will be hereinafter described, the housing of the device can be opened and accessed. The latch plate 30 additionally includes a latch cam face 34 which is positioned to be actuated by a cam 40, as will be hereinafter discussed, to withdraw the latch 32 into the lock housing 20. The latch plate 30 additionally includes a latch stopper recess 36 which is sized to be engaged by a stopper 39 to prevent movement of the latch plate 30 unless and until the stopper 39 is withdrawn from the latch stopper recess 36 of the latch plate 30 to allow for movement of the latch plate 30 with respect to the lock housing 20.

Attached to the first cylinder 22 is a first cam 40 which is attached to the first cylinder 22 by first cam attachment bolt 44 or by any other means known in the art such as being formed integrally therewith. First cam 40 includes a first cam face 42. The first cam face 42 is sized and positioned to coact with the latch cam face 34 as will be hereinafter described.

Figure 6:
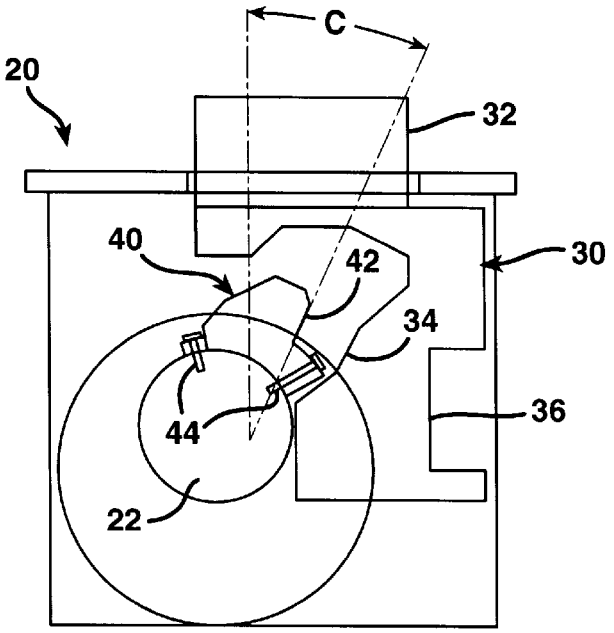
FIG. 6 is a top plan view of the lock shown in FIG. 4 rotated through an angle C.
Figure 7:
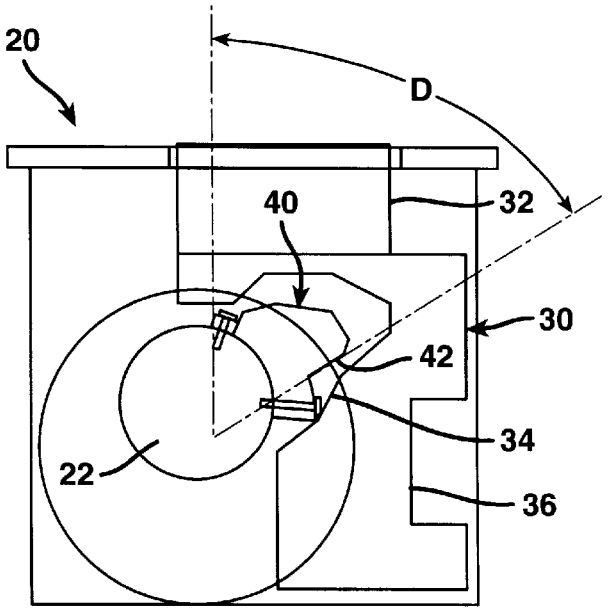
FIG. 7 is a top plan view of the lock shown in FIG. 6 rotated through an angle D to a fully rotated position.

Referring now to FIGS. 6 and 7, it can be seen that rotation of the first cylinder 22 moves the first cam 40. As shown in FIG. 6, the first key 26 can be utilized to rotate the first cylinder 22 by first cylinder actuation means 27 through an angle C before the first cam face 42 contacts the latch cam face 34. It is during this period of rotation that the key electronics associated with first key 26 communicates with the lock electronics contained within the housing (not shown) to actuate a solenoid (not shown) within the device housing which retracts stopper 39 from engagement with the latch stopper recess 36. The key electronics 39' typically comprise a hand held device with computer chips and associated circuitry. The electronics interface the lock electronics through an electrical conduit within the first key, or alternatively, the handheld can connect to the lock electronics through a separate port. Note that if the proper signal is not communicated between the first key 26 and the electronics within the housing then the stopper 39 will not be withdrawn from the latch stopper recess 36 and the electronic lock will not be actuated by the first key 26. However, when the electronic communication between the first key 26 and the electronics within the housing are operational, and the authorization for use of the first key 26 is confirmed, the lock electronics will actuate the solenoid (not shown) to withdraw the stopper 39 from the latch stopper recess 36. Thereafter, additional rotation of the first key 26, and accordingly the first cylinder 22, will move the first cam through an angle D, shown in FIG. 7 to contact the latch cam face 34 and drive the latch plate 30 to within the housing to retract the latch 32 to within the housing to open the lock.

Figure 5:
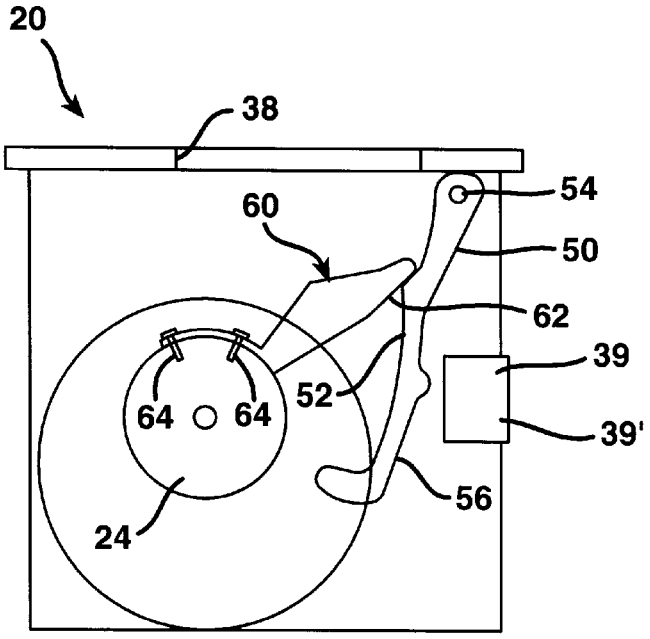
FIG. 5 is a top plan view of the second portion of the lock shown in FIGS. 1 and 2.

Referring back to FIG. 2 and also FIG. 5, where same can be more clearly seen, the second cylinder 24 is positioned in axial alignment with the first cylinder 22. In the event that the electronics fail or in the event that one desires to override the electronics, the lock can be manually actuated by using a second key 28 to actuate the second cylinder 24 and the second cam 60 to retract the stopper 39 from the latch stopper recess 36 as will be hereinafter described. Attached to second cylinder 24 is second cam 60. Second cam 60 includes second cam face 62. Second cam 60 is attached to the second cylinder 24 by means of second cam attachment bolts 64 or by any other means known in the art. Referring back to FIG. 1, it can be seen that second key 28 includes not only first cylinder actuation means 27 but also second cylinder actuation means 29. Accordingly, when the second key 28 is inserted into the first and second cylinders 22 and 24 respectively, the second cylinder actuation means 29 coacts with the second cylinder 24 such that rotation of the second cylinder 24 contacts the second cam face 62 of second cam 60 against second cam follower 50.

Second cam follower 50 is interconnected with the lock housing 20 by means of a pivot 54. Second cam follower 50 includes a second cam face 52 which is contacted by and coacts with the second cam face 62 of second cam 60. Additionally, the second cam follower 50 has a rear face 56 which contacts and coats with the stopper 39 to move the stopper 39 out from engagement with the latch stopper recess 36.

Figure 8:
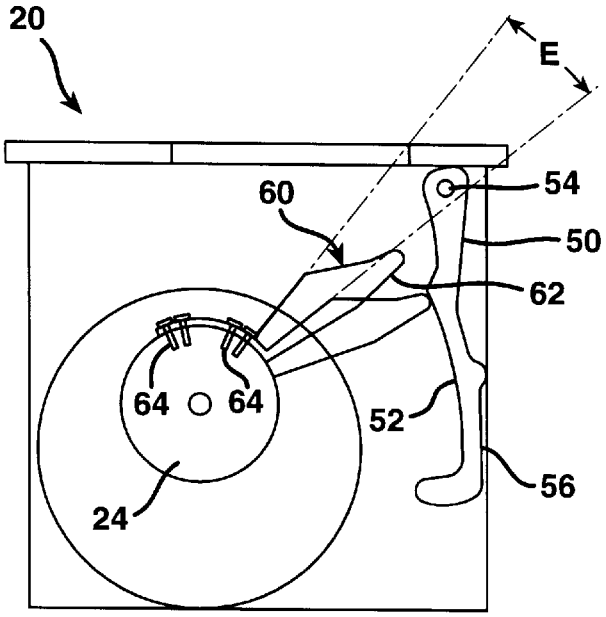
FIG. 8 is a top plan view of the lock shown in FIG. 5 rotated through an angle E.

Accordingly, as shown in FIG. 8, when the second cylinder 24 is rotated through an angle E by second key 28, the second cam face 62 of second cam 60 contacts the second cam face 52 of second cam follower 50 to move the second cam follower 50 about pivot point 54 such that the rear face 56 contacts and moves the stopper 39 to outside of the latch stopper recess 36. It should be noted that other configurations for manually moving the stopper 39 from latch stopper recess 36 are considered within the scope of the present invention.

Figure 9:
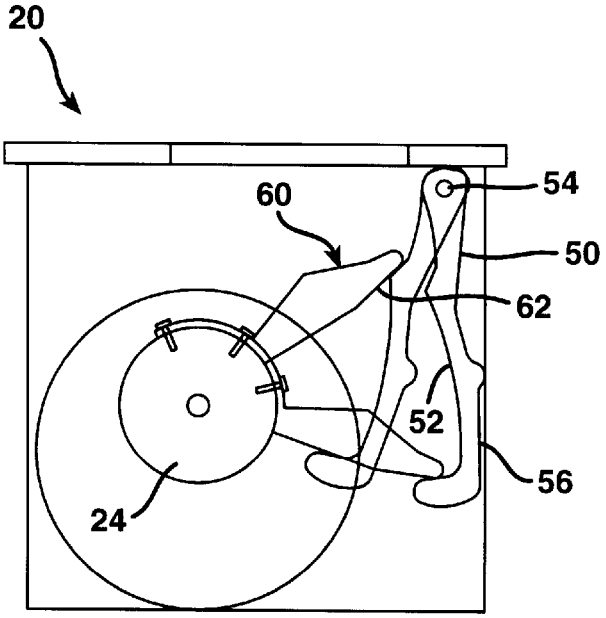
FIG. 9 is a top plan view of the lock shown in FIG. 6 in a fully rotated position.

Referring back to FIG. 6, and comparing FIG. 6 with FIG. 8, it can be seen that the second cylinder 24 rotates through an angle E to manually override the electronics of the lock, while the first cylinder 22 can move through a larger angle C before engagement is made between the first cam 40 and the latch cam face 34. Accordingly, when the electronics fail, the second key 28 is inserted into the cylinders 22 and 24, and as the second key 28 is turned, the second cylinder 24 is initially actuated to remove the stopper 39 from the latch stopper recess 36, and as the key continues to turn, the first cylinder actuation means 27 on the second key 28 then coacts with the first cylinder 22 to thereafter drive the first cam to retract the latch 32 to within the housing 20 as the second key 28 is further turned through angle D shown in FIG. 7. Likewise, FIG. 9 shows the second cylinder 24 and the second cam 60 additionally rotated through the angle D and it can be seen that the second cam 60 is free to rotate past angle E but retains the second cam follower 50 in a fully actuated position to maintain the stopper 39 out of engagement with the latch plate 30.

As can be seen, the first key 26 can be utilized to open the electronic lock 20, the first cylinder actuation means 27 coacting with the first cylinder 22 to first electronically remove stopper 39 from engagement with latch plate 30, and then to move first cam 40 against latch cam face 34 to withdraw the latch 32 to within the housing. However, in the event of an electronics failure, or if the need to manually actuate the lock otherwise arises, the lock can be manually actuated by using second key 28. Second key 28 includes first cylinder actuation means 27 and second cylinder actuation means 29. In use, the second key 28 is inserted into first and second cylinders 22 and 24 and then rotated. Initially, the second cylinder actuation means coacts with the second cylinder 24 to move second cam 60 against second cam follower 50 to remove stopper 39 from engagement with latch plate 30. Thereafter, continued rotation of the second key 28 retains the second cam follower 50 in an actuated position but the first cylinder actuation means 27 coacts with the first cylinder 22 to move first cam 40 against the latch cam face 34 to retract the latch 32 to within the housing to open the housing.

Importantly, the present invention provides a manual means of actuating an electronic lock that can be used in the event of an electronics failure or in the event that one desires to manually open the lock. Different cam arrangements and other means of manually actuating the lock are considered within the scope of the present invention. Importantly, the lock comprises first and second cylinders that can act together and/or independently based on the key that is used. Accordingly, a first key can provide access to a housing secured by a lock of the present invention if the electronics permits such actuation. Alternatively, the second key can be utilized to override the electronics when desired.

Having thus described the invention in detail, it is to be understood that the foregoing description is not intended to limit the spirit and scope thereof. What is desired to be protected by Letters Patent is set forth in the appended claims.

What is claimed is:

1. An electronic lock apparatus comprising:

lock housing means;

latch means within the lock housing means and projectable from the housing means into a locked position and retractable into the housing means into an unlocked position;

electronically actuated stopper means coacting with the latch means to prevent unauthorized movement of the latch means;

electronic means associated with a first key means for removing the stopper means from engagement with the latch means;

lock actuation means actuated by the first key means for manually moving the latch means from the locked to the unlocked position; and second key means for actuating manual stopper actuation means to manually remove the stopper means from engagement the latch means, the second key means including lock actuation means for manually moving the latch means from the locked to the unlocked position.

2. The apparatus of claim 1 wherein the lock actuation means comprises a first cylinder having cam means thereon for coacting with cam follower means on the latch means to move the latch means from the locked to the unlocked position.

3. The apparatus of claim 2 wherein the manual stopper actuation means comprises a second cylinder having second cam means thereon for coating with second cam follower means to remove the stopper means from engagement with the latch means.

4. The apparatus of claim 3 wherein the first and second cylinders are axially aligned.

5. The apparatus of claim 4 wherein the first key means actuates the first cylinder and the second key means actuates the first and second cylinders.

6. The apparatus of claim 3 wherein the second cam follower means is pivotally attached to the lock housing means.

7. The apparatus of claim 6 wherein the second cam means pivots the second cam follower means from a first position to a second position, the second cam follower means contacting the stopper means to move the stopper means from a first engaged position to a second disengaged position.

8. An electronic lock assembly apparatus that can be manually actuated comprising:

a first key;

a first cylinder having a first cam for driving a latch to open the lock assembly, the first cylinder actuated by the first key;

electronic means associated with the first key and first cylinder for electronically removing a stopper from engagement with the latch; and a second key;

a second cylinder including a second cam for contacting a cam follower to drive the stopper from engagement with the latch, the second cylinder actuated by the second key, the second key additionally actuating the second cylinder and manually driving the latch to open the lock assembly;

whereby, the lock assembly can be opened by a first key with electronic means, and the lock assembly can be actuated by a second key that coacts manually with the first and second cylinders to open the lock assembly.

9. The apparatus of claim 8 wherein the first and second cylinders are axially aligned.

10. The appparatus of claim 9 wherein the cam follower is pivotally attached to a lock housing means.

11. The apparatus of claim 10 wherein the second cam pivots the cam follower from a first position to a second postion, the cam follower contacting the stopper to move the stopper from a first engaged position to a second disengaged position.

12. A method of manually actuating an electronic lock comprising:

providing a first cylinder with electronic means for removing a stopper from engagement with a latch;

providing the first cylinder with cam means for manually driving the latch to open the lock;

providing a second cylinder with cam means for contacting a cam follower to manually drive the stopper from engagement with the latch;

electronically removing the stopper from the latch by a first key means;

moving the first cylinder cam means to move the latch; and manually removing the stopper using a second key means to rotate the second cylinder to manually drive the cam follower to remove the stopper from the latch; and thereafter rotating the first cylinder to drive the latch to open the lock.

13. The method of claim 12 wherein the step of electronically removing the stopper from the latch comprises the step of energizing a solenoid to remove the stopper from the latch.

14. The method of claim 12 wherein turning the second key means turns the first and second cylinders together.

15. The method of claim 14 wherein turning the second key means turns the second cylinder to remove the stopper from the latch and then the cam means on the first cylinder moves the latch to open the lock.

* * * * *